United States Patent [19]

Kube

[11] 4,417,847

[45] Nov. 29, 1983

[54] SEPARATE QUENCH AND EVAPORATIVE COOLING OF COMPRESSOR DISCHARGE STREAM

[75] Inventor: Gebhard K. Kube, Roesrath, Fed. Rep. of Germany

[73] Assignee: Exxon Research & Engineering Co., Florham Park, N.J.

[21] Appl. No.: 292,892

[22] Filed: Aug. 14, 1981

[51] Int. Cl.[3] ..... F04D 29/58

[52] U.S. Cl. ..... 415/1; 415/116

[58] Field of Search ..... 415/1, 116, 117, 179; 417/243

[56] References Cited

U.S. PATENT DOCUMENTS

| | | | |
|---|---|---|---|
| 2,786,626 | 3/1957 | Redcay | 415/116 X |
| 2,819,836 | 1/1958 | Eberle | 415/144 |
| 3,947,146 | 3/1976 | Schuster | 415/116 X |
| 4,303,372 | 12/1981 | Caffrey | 415/1 X |
| 4,321,006 | 3/1982 | von Ohain et al. | 415/116 X |
| 4,362,462 | 12/1982 | Blotenberg | 415/1 |

OTHER PUBLICATIONS

An article in the Oil and Gas Journal, Apr. 2, 1979, p. 74.

*Primary Examiner*—Everette A. Powell, Jr.
*Attorney, Agent, or Firm*—Rebecca Yablonsky

[57] ABSTRACT

In the compression of gases with interstage cooling in low pressure drop towers in which evaporative and non-evaporative cooling liquids are used to cool the compressed gases, the present improvement comprises introducing the non-evaporative cooling liquid as a stream in a direct contact zone and introducing the evaporative cooling liquid as a separate stream in a direct contact zone thereabove and removing evaporative cooling liquid between said zones so as to prevent it from mixing with the non-evaporative cooling liquid stream.

7 Claims, 2 Drawing Figures

SEPARATE QUENCH AND EVAPORATIVE COOLING OF COMPRESSOR DISCHARGE STREAM

This invention relates to an improvement in a system for the removal of the heat of compression produced during the compression of a gas by heat exchange with a liquid cooling medium, and in particular to the cooling of a multicomponent hydrocarbon gas in a plurality of compression stages, in which reduction of power consumption is achieved.

A process for ethylene production is known wherein a suitable starting material, for example naphtha or gas oil, is cracked, the pyrolysis products are quenched and separated into fractions in a primary fractionator and cracked light ends are subsequently subjected to a multistage compression before entering a low temperature separation section wherein low boiling hydrocarbons, such as ethylene, ethane, methane, as well as hydrogen are separated by rectification. This invention relates particularly to multistage compression with interstage cooling of such cracked gas.

BACKGROUND OF THE INVENTION

Redcay, in U.S. Pat. No. 2,786,626 discloses direct injection of cooling liquid into the gases undergoing compression. There is no interstage cooling since the coolant is sprayed directly into the compressor. Water or low boiling hydrocarbon or both may be used but in the latter case the water and hydrocarbon are employed as a mixture.

A common interstage cooling technique is to use a shell-and-tube heat exchanger and a drum to separate liquid from gas.

An article in the Oil and Gas Journal, Apr. 2, 1979, p. 74, discloses water as the cooling medium.

Schuster in U.S. Pat. No. 3,947,146 carries out multistage compression with interstage cooling of hydrocarbon process gas by a direct contact cooling system in cooling towers. In this scheme the hydrocarbon coolant is not kept separate from the water coolant. The patent shows that some of the hydrocarbons condense out of the process gas in each stage and remain with the water as a supplementary cooling medium in the cooling tower. However, it has been found that there are high compressor power requirements associated with this scheme. The hydrocarbon is permitted to run down the cooling tower, with the water, where it is to be skimmed off the water at the bottom. This has the disadvantage of causing a large part of the hydrocarbon to be stripped out overhead without cooling the compressed gas, which in turn causes buildup of a large hydrocarbon recycle that increases the load on the compressor. The stripping of the hydrocarbon overhead results in evaporative cooling of the water so that the temperature of the water at the bottom is almost the same as at the inlet to the tower (it should be 20° to 30° C. higher) whereas the compressed gas leaving the top of the tower is 5° to 10° C. higher than would be expected. The presence of the hydrocarbon in the water to the tower and its subsequent vaporization prevent the water from cooling the gas. In effect, this cools the water instead of cooling the gas. The high hydrocarbon recycle rate and the high inlet temperature of the gas to the subsequent compression stage, result in high compressor power requirements.

According to the present invention, this malfunctioning is corrected by separating water and hydrocarbon in the cooling tower, as described in the following.

SUMMARY OF THE INVENTION

According to the present invention, a compressor discharge stream of a mixture of gases having different boiling points, is cooled by direct contact in sequence with (a) non-evaporative cooling liquid which acts as a quench to remove sensible heat from the compressed gas and (b) evaporative cooling liquid which cools the gas by evaporation. Advantageously, multistage compression is carried out, with cooling between compression stages. The quench liquid is preferably water and the evaporative cooling liquid is preferably hydrocarbons derived by condensation of a portion of the compressed gas. It will be understood that the term "evaporative" means that such liquid is at least partially vaporizable under the conditions prevailing whereas the term "non-evaporative" means that such liquid has a lower vapor pressure and substantially does not vaporize. The gases undergoing compression may be cracked gases such as the light ends from a steam cracking process or from a high pressure hydrocracking system or from cocracking (integrated coking and steam cracking). In practice such effluents are liquefied by compression and subsequent refrigeration in order to be separated by distillation.

In each interstage cooling step of a multistage system, the non-evaporative cooling liquid and the evaporative cooling liquid are introduced as separate direct contact streams, i.e., not by indirect heat exchange, so as to define a non-evaporative cooling liquid contact zone and a separate evaporative cooling liquid contact zone. Typically, a cooling tower is used in which the evaporative cooling liquid contact zone is located above the non-evaporative cooling liquid contact zone with the compressed gas flowing in countercurrent contact with these incoming streams; and an evaporative cooling liquid stream is removed from a location between said contact zones such as by a draw-off pan. In this way, in a typical operation, hydrocarbon cooling liquid is substantially not permitted to run down the tower (it is drawn off by the draw-off pan) and mix with the water cooling liquid so that the problems encountered with prior disclosures, as discussed above, are avoided. The tower contains gas-liquid contacting means for effecting heat transfer, preferably trays; or alternatively packing of a suitable nature, preferably Pall rings. Such means should be selected for effecting good contact between liquid and gas but providing enough open space so that there is a low pressure drop through the column in order to avoid dissipating the high compression of the gas.

As will be explained more fully, this hydrocarbon cooling liquid is conveniently obtained from the discharge cooler of the compressor and is passed to cooling steps in succession in an upstream direction from the high pressure side of the process towards the low pressure side whereby evaporative cooling takes place.

BRIEF DESCRIPTION OF THE DRAWINGS

The invention is illustrated in connection with the drawings in which.

DETAILED DESCRIPTION

Figure 1:
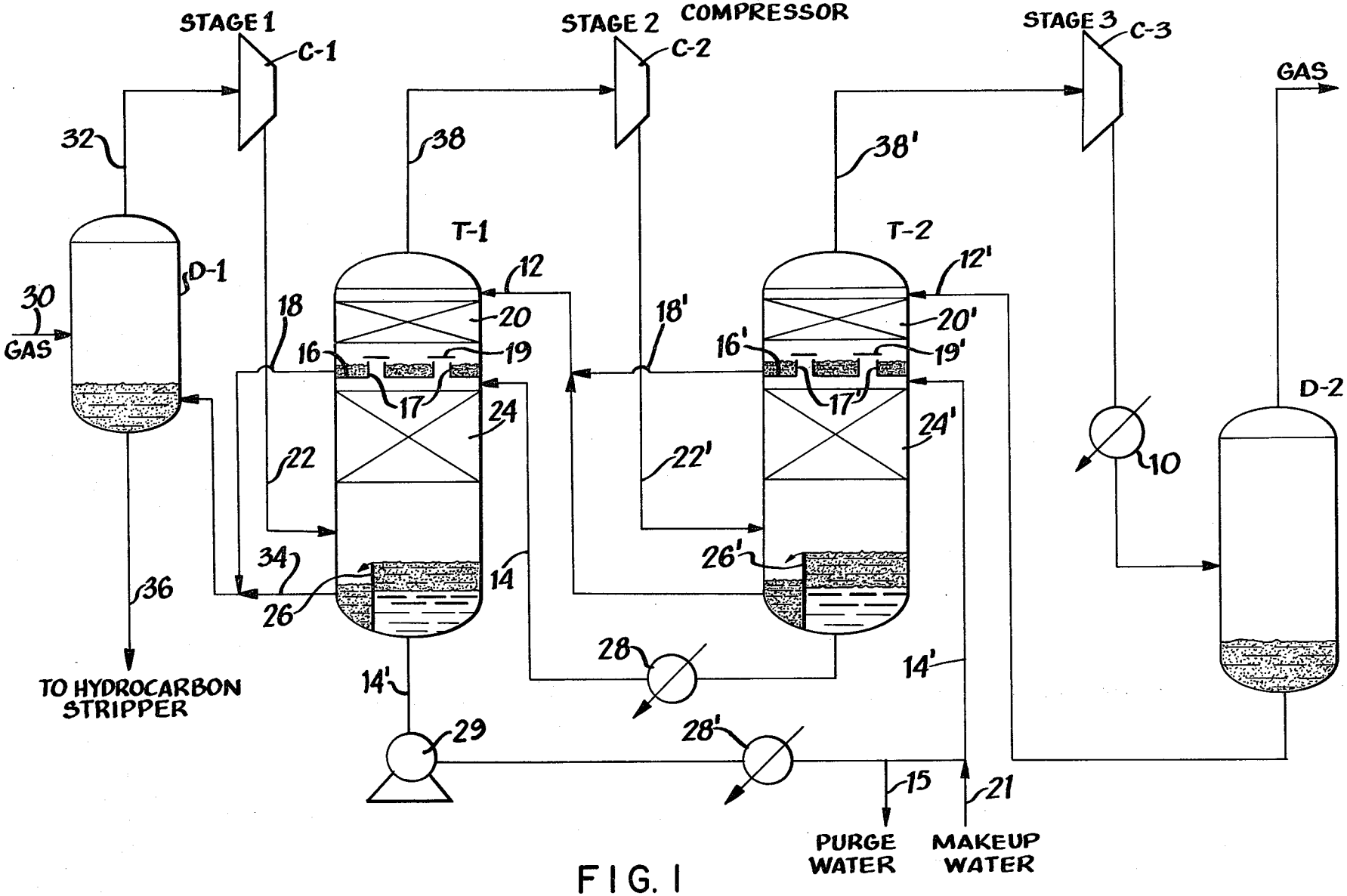
FIG. 1 is a flow diagram of a multistage compression with interstage cooling system showing one form of cooling tower.

As shown in FIG. 1, the compressor may comprise a gas feed drum D-1 and three stages of which C-1 is the first stage compressor, C-2 the second and C-3 the third. Cooling tower T-1 is connected between C-1 and C-2 so as to receive hot compressed gas from C-1 and pass cooled gas to C-2. Cooling tower T-2 is similarly connected between C-2 and C-3 to receive hot compressed gas from C-2 and pass cooled gas to C-3. The effluent of the last stage compressor, C-3, is suitably passed to the discharge cooler 10, thence to a separating drum, D-2.

Tower T-1 is provided in its upper portion with an inlet line 12 for evaporative cooling liquid, an inlet line 14 therebelow for non-evaporative cooling liquid, between these feed points a draw-off pan 16 which is a plate formed with a number of chimneys 17 through which vapor flows and having a draw-off line 18, packing 20 of suitable type above pan 16; and in its lower portion is provided with an inlet 22 for compressed gas, packing 24 thereabove but below pan 16 and a baffle 26 at the bottom of the tower to assist in separating liquids. The non-evaporative cooling stream flowing in line 14 is cooled in water-cooled heat exchanger 28.

Draw-off pan 16 is a plate fitted with vapor risers 17 as shown in FIG. 1. Liquid collects on top of the plate and is drawn off through line 18. Liquid is prevented from falling through the openings by a baffle 19 located above the risers. Other devices for drawing off evaporative cooling liquid may be used and other low pressure drop liquid-gas contacting devices for heat transfer, e.g., shed-type trays may be used in lieu of packing.

Similar provisions are made for tower T-2, like parts being designated by like numbers followed by the prime sign.

Figure 2:
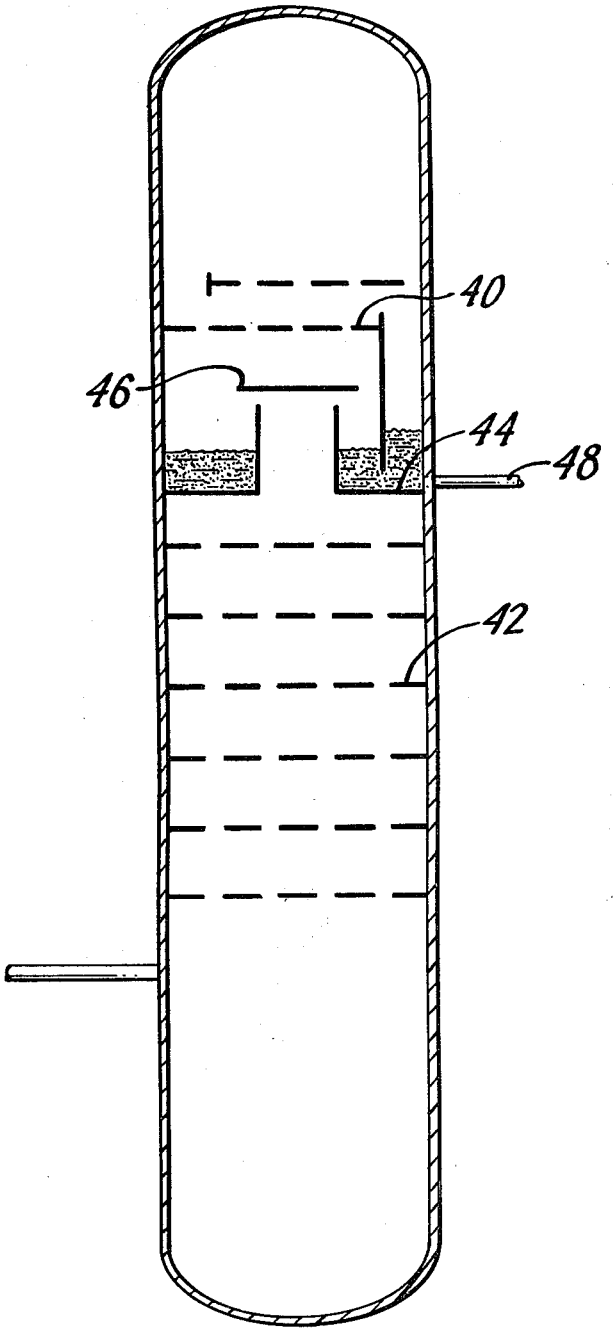
FIG. 2 is a preferred form of cooling tower.

In a preferred mode, the cooling towers have the form seen in FIG. 2. In lieu of packing sections 20 and 24, trays are provided in sections 40 and 42, respectively. The pan 16 and baffle 19 of FIG. 1 are replaced by the pan 44 and baffle 46, the latter being affixed to the pan by a number of supports (not shown). Evaporative cooling liquid flowing down from the trays 40 collects in the pan 44 and is removed therefrom by line 48 while upflowing vapor passes through the space between the pan and the baffle.

In operation, a feed gas which may be the light ends fraction of a steam cracked petroleum distillate, has the following typical mol % composition which is not to be considered as limiting the invention: about 15% $H_2$, 24% methane, 32% ethylene, 4% ethane, 9% propylene, 2% butadiene and minor amounts of other components including acetylenes, propane, butenes, pentane, hexane and aromatics plus water. The feed is passed by line 30 into feed drum D-1, thence by line 32 into C-1 from which hot compressed gas issues and is passed by line 22 into a lower section of tower T-1. The hot gas from the compressor is first cooled by water (free of hydrocarbon) in Pall ring section 24 of the tower (or trays 42- refer to FIG. 2). About 2 to 6 theoretical stages of packing are suitable. This removes heat from the gas. In the process of this cooling, some hydrocarbons are condensed from the gas. The lighter part of the hydocarbon is revaporized but some of it is heavy enough, i.e., high enough in boiling point, to go to the bottom of the tower with the water. The hydrocarbon reaching the bottom is separated from the water and withdrawn from the tower. This is facilitated by baffle 26 which divides the bottom of the tower into two segments whereby the denser water is removed at the bottom by line 14', pumped by pump 29, cooled in heat exchanger 28' and passed to T-2, and the less dense hydrocarbon is removed as a side-stream via line 34. The cooled gas is then contacted with liquid hydrocarbon from the subsequent compression stage, introduced through line 12, in the Pall ring section 20 of the tower (or trays 40 - refer to FIG. 2) in order to vaporize the lighter components in the hydrocarbon. About 1 to 2 theoretical stages of packing are suitable in this section. The hydrocarbon liquid from this section is removed by means of the draw-off pan 16 via line 18 and not permitted to enter the water cooling stage and joins the much smaller stream of hydrocarbons in line 34 whence the combined streams flow to the feed drum D-1 and are then passed by line 36 to a hydrocarbon stripper (not shown). The vaporization that occurs in section 20 results in further cooling of the gas. This contacting of the hydrocarbon from the subsequent compression stage with the cooled gas is desirable because it assists in reducing power requirements on the compressor as will be shown in Table 1 further below. In most essentials tower T-2 is operated in a manner similar to T-1 but it may be noted that water withdrawn from the bottom of T-2 is recycled to T-1 through water feed line 14 and hydrocarbon cooling liquid is fed to T-2 from dischasrge cooler 10 and separating drum D-2 by line 12'. As shown in FIG. 1, water is continuously circulated between T-1 and T-2; purge water may be removed via line 15 and make-up water added via line 21. Alternatively, fresh water may be introduced separately to each tower and withdrawn separately. Also, additional compression stages may be employed if that is desirable. Operation with the apparatus of FIG. 2 is similar.

To illustrate mass flow rate and temperature relationships in tower T-1, 189 t/h (tons per hour) of compressed gas at 94.7° C. from C-1, are introduced by line 22. The gas flows upwards, first contacting water which is fed in by line 14 at 20° C. at a rate of 280 t/h and which flows downwards through packed section 24 in countercurrent contact with the gas. Pressure drop through this section is only about 0.1 psi and is less in packed section 20. This cools the gas to 23.4° C. The gas then flows through the vapor risers 17 in draw-off pan 16 and contacts a liquid hydrocarbon stream taken from the downstream cooling tower T-2 which is fed in by line 12 at 32° C. at a rate of 18.2 t/h and which flows downwards through packed section 20 in countercurrent contact with the gas. 193 t/h of cooled gas at 18.9° C. exits the tower via line 38 and passes to C-2. Liquid hydrocarbons are removed from the draw-off plate 16 by line 18 at 18.9° C. at a rate of 11.6 t/h while at the lower end of the tower 1.9 t/h of hydrocarbon are removed by line 34 and joined by the stream in line 18 and water at 48.7° C. is removed by line 14'.

The 18.2 t/h liquid hydrocarbon stream passing into tower T-1 by line 12 is comprised of 18.1 t/h taken from draw-off pan 16' by line 18' from tower T-2 and 0.1 t/h removed at the lower end of T-2, these two streams being joined in line 12. Tower T-2 receives a liquid hydrocarbon stream by line 12' from separation drum D-2 at the rate of 23.2 t/h.

These figures demonstrate that:

The water taken off at the bottom of a cooling tower is roughly 30° C. higher than the inlet water, which is desirable.

The gas leaving the top of the tower is at a suitable low temperature which is actually lower than the cooling water because of the evaporative cooling of the hydrocarbons.

The hydrocarbon cooling liquid used in the evaporative cooling section is drawn off by the draw-off pan. A relatively minor amount of hydrocarbon condensed from the gas in the water quench section is removed from the bottom of the tower.

There is a difference between the amount of hydrocarbon cooling liquid injected into the tower and the sum of the amounts removed by the draw-off pan and from the bottom, which shows that a portion of hydrocarbon evaporates resulting in additional cooling of the gas by evaporative means thus lowering compressor power requirements.

There is a diminishing quantity of hydrocarbon cooling liquid being transferred starting with drum D-2 to T-2, then T-1 and finally to D-1, which again shows that a portion of hydrocarbon evaporates in each cooling stage.

The savings in mega watts on the compressor when changing from the system of U.S. Pat. No. 3,947,146 to that of the present invention as illustrated in FIG. 1 is indicated in Table 1.

TABLE 1

| | U.S. Pat. No. 3,947,146 | | Present Invention |
|---|---|---|---|
| Stage 1 compressor | | | |
| inlet T, °C. | 31.4 | | 31.4 |
| outlet T, °C. | 94.7 | | 94.7 |
| rate Ton/min | 189 | | 189 |
| inlet P, atmos | | 1.1 | |
| outlet P, atmos | | 1.9 | |
| MW | 6.580 | | 6.580 |
| Stage 2 compressor | | | |
| inlet T, °C. | 34.5 | | 31.2 |
| outlet T, °C. | 90.9 | | 89.0 |
| rate Ton/min | 231 | | 211 |
| outlet P, atmos | | 4.0 | |
| MW | 6.546 | | 6.310 |
| Stage 3 compressor | | | |
| inlet T, °C. | 43.9 | | 39.5 |
| outlet T, °C. | 99.3 | | 95.5 |
| rate, Ton/min | 226 | | 213 |
| outlet P, atmos | | 7.5 | |
| Total Power, MW | 19.549 | | 19.084 |
| Power Savings, MW | Base | | 0.465 |

The above figures further show that when the stage 1 compressor conditions are the same in the two processes, when using the known process the stage 2 and stage 3 compressors are handling more gas (overhead from cooling towers) and the compressor inlet temperatures are higher so that there is a greater load on the compressor, as compared with the present process.

It can thus be seen that the subject invention achieves its objectives, saves power and is economical.

What is claimed is:

1. A process for multistage compression with interstage cooling of a mixture of gases having different boiling points which comprises, in each interstage cooling step, cooling the compressed gas by direct contact in sequence with a non-evaporative cooling liquid and then with a separate evaporative cooling liquid.

2. A process according to claim 1 in which evaporative cooling liquid is derived by condensation of a portion of the compressed gas and said liquid is passed to interstage cooling steps in succession in an upstream direction.

3. A process according to claim 1 in which the gas compressed by the last stage compressor is cooled by indirect heat exchange to condense evaporative cooling liquid from the compressed gas and said liquid is passed to interstage cooling steps in succession from the high pressure side of the process to the low pressure side.

4. A process according to claim 1, 2 or 3 in which, in each interstage cooling step, the non-evaporative cooling liquid and the evaporative cooling liquid are maintained as separate direct contact streams so as to define a non-evaporative cooling liquid contact zone and an evaporative cooling liquid contact zone whereby cooling is effected in said sequence.

5. A process for multistage compression with interstage cooling of a mixture of gases having different boiling points which comprises, in each interstage cooling step, cooling the compressed gas in a low pressure drop tower by direct countercurrent contact sequentially with non-evaporative cooling liquid in a contact zone and with an evaporative cooling liquid in a contact zone located thereabove; removing evaporative cooling liquid from a location between said zones; each cooling tower receiving evaporative cooling liquid from the next subsequent cooling tower or from the gas from the last compressor which has been cooled and partially condensed.

6. A process according to claim 5 which comprises separating, at the lower end of the tower, a relatively minor portion of condensed evaporative cooling components from non-evaporative cooling liquid and removing them.

7. A process according to claim 1, 5 or 6 in which the evaporative cooling liquid is hydrocarbon and the non-evaporative cooling liquid is water.

* * * * *